US008664855B2

(12) United States Patent
Buttstaedt et al.

(10) Patent No.: US 8,664,855 B2
(45) Date of Patent: Mar. 4, 2014

(54) HIGH-PRESSURE DISCHARGE LAMP HAVING A CAPACITIVE IGNITION AID

(75) Inventors: Johannes Buttstaedt, Falkensee (DE); Stefan Dunkel, Berlin (DE); Leon Grabinski, Berlin (DE); Janbernd Hentschel, Eichstaett (DE); Bernd Koch, Berlin (DE); Stefan Lichtenberg, Falkensee (DE); Martin Tueshaus, Berlin (DE)

(73) Assignee: Osram AG, Munich (DE)

( * ) Notice: Subject to any disclaimer, the term of this patent is extended or adjusted under 35 U.S.C. 154(b) by 0 days.

(21) Appl. No.: 13/812,521

(22) PCT Filed: Oct. 8, 2010

(86) PCT No.: PCT/EP2010/065061

§ 371 (c)(1), (2), (4) Date: Jan. 28, 2013

(87) PCT Pub. No.: WO2012/045366

PCT Pub. Date: Apr. 12, 2012

(65) Prior Publication Data

US 2013/0181604 A1 Jul. 18, 2013

(51) Int. Cl.
*H01J 61/04* (2006.01)
*H01J 61/20* (2006.01)

(52) U.S. Cl.
USPC ..... 313/623; 313/627; 313/626; 313/631

(58) Field of Classification Search
USPC ..... 445/22, 26, 27
See application file for complete search history.

(56) References Cited

U.S. PATENT DOCUMENTS

| | | | | |
|---|---|---|---|---|
| 6,198,223 | B1 | 3/2001 | Scholz | |
| 6,268,698 | B1 | 7/2001 | Scholz | |
| 6,593,706 | B1 | 7/2003 | Sze et al. | |
| 6,624,580 | B2 | 9/2003 | Kanegae et al. | |
| 6,696,788 | B2 * | 2/2004 | Lapatovich et al. | 313/634 |
| 2010/0181926 | A1 | 7/2010 | Ozasa et al. | |

FOREIGN PATENT DOCUMENTS

| | | | |
|---|---|---|---|
| JP | 2003092082 | A | 3/2003 |
| JP | 2007073436 | A | 3/2007 |
| WO | 2008007284 | A2 | 1/2008 |
| WO | 2008154102 | A2 | 12/2008 |

OTHER PUBLICATIONS

Okanuma, Tsuneo, Japanese Patent Application Publication 2003-092082,Mar. 2003, machine translation.*
English language abstract of JP 2003092082 A dated Mar. 28, 2003.
English language abstract of JP 2007073436 A dated Mar. 22, 2007.

* cited by examiner

*Primary Examiner* — Tracie Y Green

(57) ABSTRACT

A high-pressure discharge lamp having an ignition aid may be provided, having a discharge vessel that is surrounded by gas, wherein the discharge vessel includes two ends having fusings in which electrodes are secured, wherein an ignition aid is fastened on at least one fusing, wherein the ignition aid has a local field amplifier in the form of a tip or a curved part, wherein the ignition aid is configured to cause a corona discharge in the surrounding gas which emits UV radiation into the discharge vessel.

14 Claims, 5 Drawing Sheets

HIGH-PRESSURE DISCHARGE LAMP HAVING A CAPACITIVE IGNITION AID

RELATED APPLICATIONS

The present application is a national stage entry according to 35 U.S.C. §371 of PCT application No. PCT/EP2010/065061filed on Oct. 8, 2010.

TECHNICAL FIELD

The invention relates to a high-pressure discharge lamp having an ignition aid, having a discharge vessel that is surrounded by gas. Such lamps are in particular high-pressure discharge lamps for general lighting or for photo-optical purposes.

BACKGROUND

A high-pressure discharge lamp with discharge vessel is known from U.S. Pat. Nos. 6,198,223 and 6,268,698 in which an ignition aid is executed as a winding around one end of the discharge vessel.

Radioactivity-free lamps require significantly higher ignition pulses than lamps with radioactive substances in the discharge vessel. In the case of general lighting, however, often only an ignition pulse of 4-5 kV is available on account of the ignitors used. Therefore ignition aids are often used to reduce the ignition voltage of the lamp by means of auxiliary structures. Various embodiments of such ignition aids are known, in which the electrical potential of one electrode is brought into proximity with the counter electrode with the aid of electrically conducting components outside the discharge vessel. To this end as a rule a wire, clip or the like is wound around the fusing, pinch or capillary tube in the proximity of the electrode and electrically connected to the current supply of the counter electrode. When the ignition voltage is applied in the region of the enclosed electrode a dielectric barrier discharge is thus produced inside the discharge vessel, which ionizes the burner filler gas and reduces the ignition voltage, see EP967631.

In the case of lamps whose discharge vessel is made of quartz glass or certain types of ceramics and contains sodium as a filling component, however, ignition aids assembled in this way result in sodium escape if they are electrically connected to one of the two current supplies. The phenomenon of sodium escape is known per se. For the lamp the loss of sodium from the discharge vessel signifies a significant impairment of the quality of light as the color temperature clearly alters and it may even go out.

In order to avoid sodium escape, it is possible to connect the ignition aid arrangement only capacitively to the electrodes, as described in WO2008154102A2, for example. However, a major disadvantage of capacitively connected ignition aids is that they are significantly less effective compared with directly contacted electric ignition aids, so that in the case of ignition pulses in the range of 4-5 kV it is often not possible to initiate discharge.

SUMMARY

Various embodiments provide a high-pressure discharge lamp whose ignition is ensured by simple, inexpensive means.

This applies, in particular, to metal halide lamps, wherein the material of the discharge vessel may be ceramics or quartz glass.

This object is achieved by the discharge vessel comprising two ends having fusings in which electrodes are secured, wherein an ignition aid is fastened on at least one fusing, wherein the ignition aid has a local field amplifier in the form of a tip or a curved part, wherein the ignition aid is configured to cause a corona discharge in the surrounding gas which emits UV radiation into the discharge vessel.

Various embodiments relate to high-pressure discharge lamps with a discharge vessel made of quartz glass or ceramics, with or without an outer bulb. Various embodiments relate in particular to discharge lamps with

- a discharge vessel made of quartz glass or ceramics
- without radioactive admixtures in the discharge vessel
- a gas-filled outer bulb or without any outer bulb at all which is started with the aid of an ignition pulse of typically 4 to 5 kV.

Various embodiments are described which ensure effective ignition of such radioactivity-free lamps particularly in the case of comparatively low ignition pulses by means of a simple, inexpensive construction.

Principally affected are discharge lamps for general lighting which as a rule have an evacuated or gas-filled outer bulb and are configured for a working life of 6000 hours or more.

Such high-pressure discharge lamps are started with the aid of special ignitors. The ignition properties of these ignitors are stipulated by corresponding standards. The conditions in the discharge vessel (volume, electrode clearance, filler gas, filling pressure, Hg volume, volume and type of metal halides) must be coordinated with each other in such a way that the lamp ignites reliably under the stipulated ignition conditions. In addition, the voltage necessary for ignition increases with increasing service life. This can result in old lamps with conventional ignitors not starting any longer. The ability to ignite must be guaranteed throughout the entire service life, however.

Various embodiments are described which ensure the reliable ignition of high-preassure discharge lamps.

Various embodiments are based on the surprising insight that at a suitably constructed ignition aid arrangement already at low ignition voltages a corona discharge can be produced in the surrounding gas, with the aid of which the actual discharge is ignited in the discharge vessel. The ignition aids known until now, regardless of whether electrically connected to an electrode or capacitively coupled, in comparison provoke a dielectric barrier discharge inside the discharge vessel and require higher ignition voltages for this purpose than the various embodiments.

WO2008/007284 describes that through the contact of a current supply with the outer bulb filler gas a discharge can be generated in the outer bulb, wherein all the other metallic components are insulated from the outer bulb gas. However, the arrangement described is only effective with ignition pulses significantly greater than 5 kV. As an example the publication states that the ignition voltage of a corresponding discharge lamp could be reduced from approximately 23 kV to approximately 17 kV through the use of the publication.

U.S. Pat. No. 6,624,580 describes that a suitable outer bulb filler gas can be excited with the aid of a dielectric discharge barrier discharge such that sufficient UV radiation is generated to ignite the lamp. However, the ignition voltages necessary for this are in the range of 10 to 20 kV, meaning that this method cannot be used for discharge lamps which must start with an ignition pulse of 4-5 kV.

A prerequisite for various embodiments is that the outer bulb of the lamp is filled with a gas which is suitable for the formation of a corona discharge, e.g. Ar, Xe or also air but also other gases or gas mixtures. The filler pressure may be between 1 bar and 10 mbar. Alternatively, a discharge vessel may also be operated directly at air, i.e. without an outer bulb.

A suitable assembly of an arrangement according to various embodiments provides that outside at the end of the discharge vessel as close as possible to the electrode an electrically conductive arrangement is attached which has one or more very small radii or sharp edges and is electrically connected to the current supply of the counter electrode (contacted version). Alternatively, the ignition aid arrangement can also be electrically connected to an arrangement of the same kind on the other side of the discharge vessel without contact with one of the two power supplies (capacitively connected version).

The capacitively connected version is particularly advantageous for use in lamps with a filler containing sodium as on the one hand a sodium escape from the discharge vessel is avoided, and on the other hand the effectiveness of the capacitively connected ignition aid is significantly improved by the generation of a corona discharge.

A particularly simple form of various embodiments in the contacted version provides for the attachment of a thin wire at one end of the discharge vessel such that the end of the wire is positioned as close as possible to the one electrode and the other end of the wire is connected to the current supply of the counter electrode. Close contact in the central region of the discharge vessel is not necessary.

Alternatively, thin foils or sheets with comb-like or serrated edges can be arranged at one end of the discharge vessel and connected to the current supply of the counter electrode.

A wire is positioned as a capacitively connected version at both ends of the discharge vessel such that each end of the wire is brought as close as possible to an electrode. Alternatively foils or sheets as described above are arranged at both ends of the discharge vessel and connected to each other.

In addition, an asymmetrical assembly is possible which only provides for an arrangement for the formation of the corona discharge on the one side of the discharge vessel and on the other side realizes a capacitive connection as effective as possible.

Various embodiments make very simple technical arrangements possible, with which discharge lamps with the aforementioned properties ignite reliably using ignitors with an ignition pulse of 4-5 kV. Various embodiments are particularly advantageous for use in lamps containing sodium in the capacitively connected version.

The ignition aid according to various embodiments is significantly more effective than a similarly constructed traditional ignition aid as the corona discharge forms on the tip of the wire at lower voltages than a dielectric barrier discharge inside the burner.

The effectiveness of an ignition aid in pinched burners is often not very great as the ignition aid arrangement has to be guided around the entire pinch and the pinch fills a large cross-sectional area resulting in the electrical fields provoked being only small. Various embodiments make it possible to position a metal tip at the specific point where the clearance is smallest between the electrode and burner exterior, resulting in a comparatively large electrical field being provoked at the metal tip.

In the known structural shapes of ignition aids, the clearance between the electrode and the inner surface of the wall of the discharge vessel in the region of the ignition aid is crucial for the effectiveness as a discharge is provoked in this region. In particular in the case of a discharge vessel made of quartz glass, however, this clearance can only be reproduced with difficulty. It follows from this that the effectiveness of the ignition aid is also subject to corresponding fluctuations. In various embodiments a discharge is generated outside the discharge vessel. The relevant clearance from the outside wall of the discharge vessel is simple to set and easy to keep constant in terms of production engineering.

The construction of the ignition aid is very simple and inexpensive as, for example, only a thin wire is required. By means of installation outside on the discharge vessel, both the burner as well as the outer bulb can be manufactured in accordance with the traditional methods without modification.

The ignition aid component is only in contact with the discharge vessel at the ends, with the result that it is not exposed to such high temperatures as components which are in contact with the discharge vessel in the central area. This simplifies the selection of materials.

As a thin wire is preferably involved, the light emitted from the discharge vessel is significantly less shielded than in other ignition aid structures.

Essential features of various embodiments in the form of a numbered list are:

1. A high-pressure discharge lamp having an ignition aid, having a discharge vessel that is surrounded by gas, in particular either by being housed in an outer bulb, which is filled with gas at a cold fill pressure of 10 mbar to 1 bar, or by having no outer bulb, wherein the discharge vessel includes two ends having fusings in which electrodes are secured, characterized in that an ignition aid is fastened on at least one fusing, wherein the ignition aid has a local field amplifier in the form of a tip or a curved part, wherein the ignition aid causes a corona discharge in the surrounding gas which emits UV radiation into the discharge vessel.

2. The high-pressure discharge lamp as in 1., characterized in that the gas is selected from the group of noble gases, air, nitrogen or mixtures thereof, in particular Ar, Xe or air.

3. The high-pressure discharge lamp as in 1., characterized in that the ignition aid is a clip which has a frame part with four sides and which is positioned on the fusing and surrounds this at least partially, wherein at least one tip extends inwardly from the frame part and in the mounted state points in the direction of the discharge volume.

4. The high-pressure discharge lamp as in 3., characterized in that at least one side of the frame part has a plurality of tips similar to the teeth of a comb.

5. The high-pressure discharge lamp as in 1., characterized in that the ignition aid is a wire with a free tip, wherein the free tip ends at the fusing outside at the height where the electrode enters the discharge volume, wherein in particular a retaining effect is obtained at the fusing by a curved part formed in a U-shape with two legs and a base, wherein the curved part is partially curved around the fusing.

6. The high-pressure discharge lamp as in 1., characterized in that the ignition aid is a spring sheet metal part to which at least one tip is attached.

7. The high-pressure discharge lamp as in 1., characterized in that the discharge vessel is made of quartz glass and has a metal halide filling.

8. The high-pressure discharge lamp as in 1., characterized in that the ignition aid is galvanically or capacitively coupled.

9. The high-pressure discharge lamp as in 9., characterized in that the ignition aid has two parts which are distributed between the two fusings, wherein the two parts are connected via a connection wire.

10. The high-pressure discharge lamp as in 9., characterized in that the ignition aid as the first part has a cuff on a first fusing and as the second part a curved piece of wire, wherein the tip attached thereto ends at the second fusing outside at the height at which the electrode enters the discharge volume.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which the figures show.

DETAILED DESCRIPTION

The following detailed description refers to the accompanying drawings that show, by way of illustration, specific details and embodiments in which the invention may be practiced.

Figure 1A:
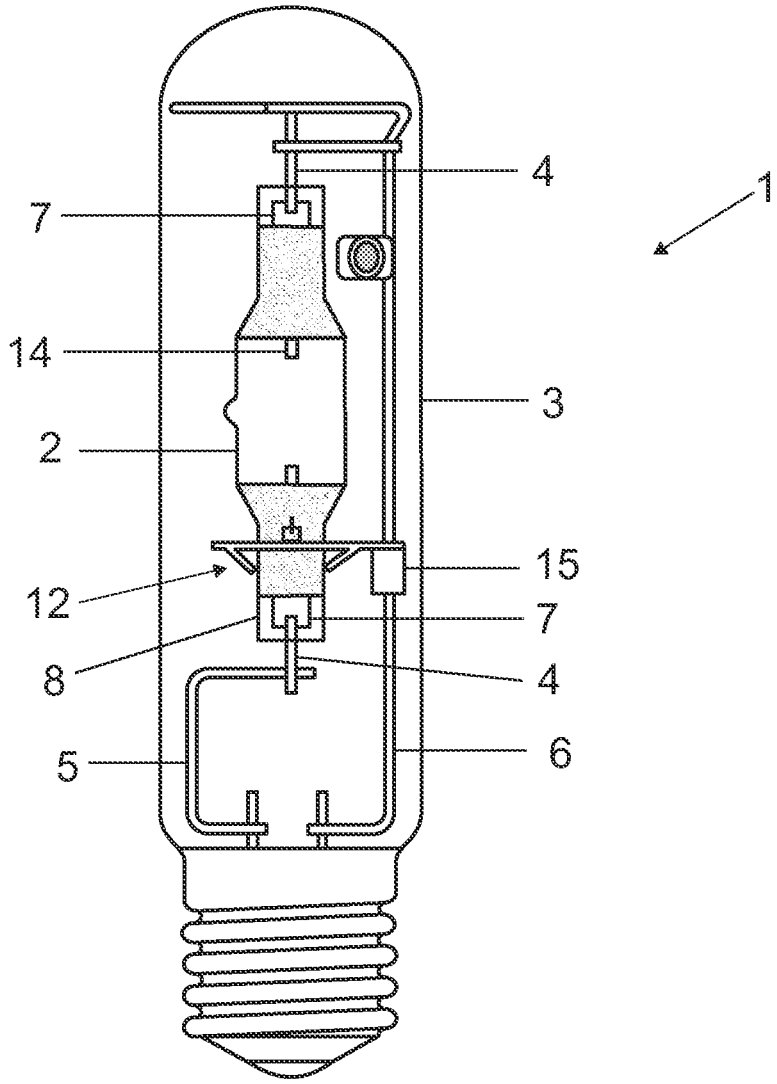
FIG. 1 a high-pressure discharge lamp with ignition aid, first exemplary embodiment (FIG. 1*a*) and detailed view of the corresponding clip (FIGS. 1*b* and 1*c*)

FIG. 1 schematically shows the basic structure of a high-pressure discharge lamp 1 having an ignition aid 12. It has a discharge vessel 2 made of quartz glass which is housed in an outer bulb 3. The outer bulb is filled with air at 1 bar cold filler pressure. The external supplies 4 of the discharge vessel, which contact electrodes 14 in the interior, are connected to two frame wires 5 and 6. A short frame wire 5 leads to a first foil 7 in a pinch 8 of the outer bulb. A long frame wire 6, frequently called a sprung wire, leads to a second foil 7 in a second pinch 8. The discharge vessel 2 has a filling of ionizable gas, as a rule argon or xenon, mercury and metal halides, as is known.

Figure 1B:
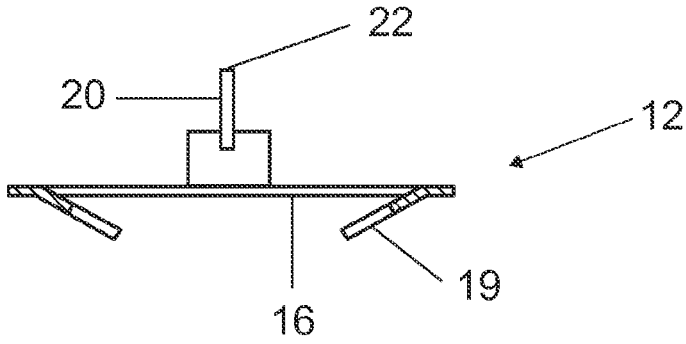
Figure 1C:
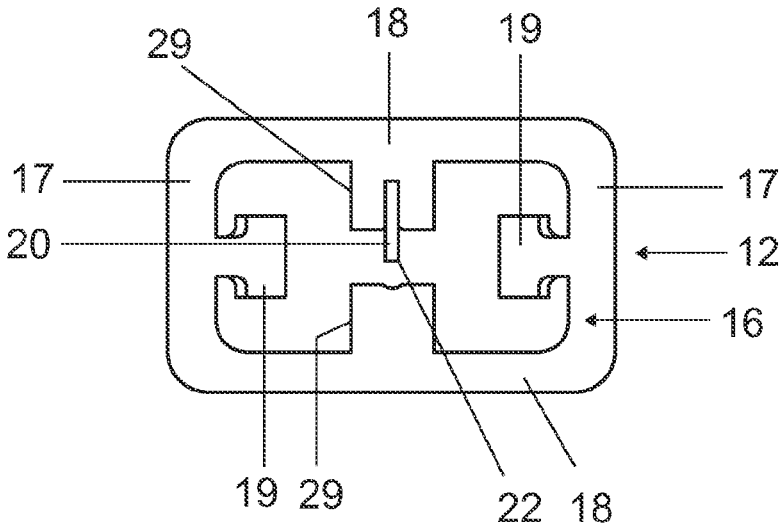

An ignition aid, see FIGS. 1*b* and 1*c*, in the form of a clip 12 is laid around a pinch 8 of the discharge vessel as a cuff and connected to the sprung wire 6 via an angle piece 15. The clip 12 has a frame part 16 which is shaped like the frame of a picture with two narrow sides 17 and two long sides 18. A spring-loaded lug 19 and 29 is situated approximately in the center on each side pointing into the empty space of the frame, to press the clip against the pinch, as is known. The lugs are bent outwards in pairs in the opposite direction from the plane of the frame. In order to provoke a corona discharge in the outer bulb, the clip also has a short piece of wire 20 which is attached to a lug 29, which immobilizes a wide side 18 and is bent in the direction of the discharge volume, and protrudes beyond this in the direction of the discharge volume. The free tip 22 of the piece of wire provokes a corona discharge in the surrounding gas in the outer bulb.

Figure 2:
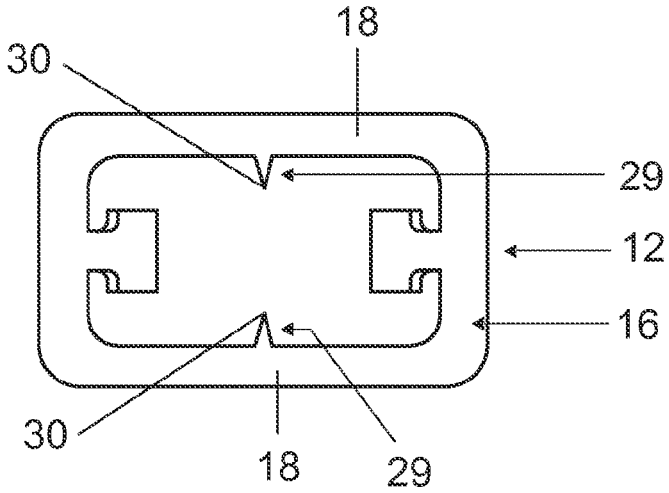
FIG. 2 a detailed view of a further exemplary embodiment of a clip.

FIG. 2 shows a clip 12 as an alternative, in which the lugs 29 are cut out of the sheet on the wide sides 18 directly with tips 30. These lugs are triangular and their tips point to the center of the empty space. During assembly they are bent in the direction of the discharge volume in order to cause a corona discharge. One or even both lugs 29 of the wide side can be shaped thus.

Figure 3A:
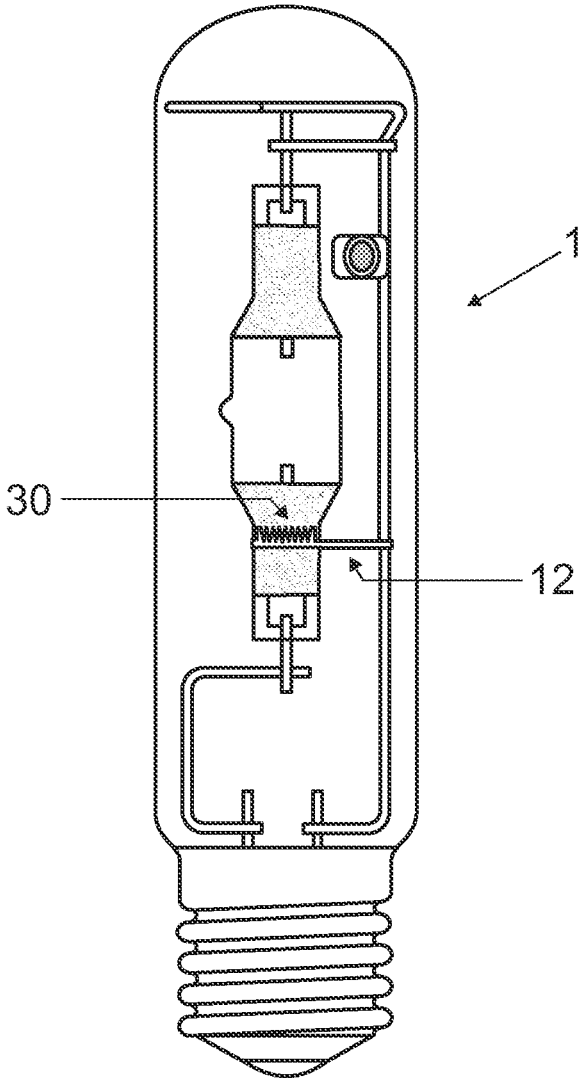
FIG. 3 a further exemplary embodiment of a high-pressure discharge lamp with ignition aid (FIG. 3*a*) and detailed view of the corresponding clip (FIG. 3*b*)
Figure 3B:
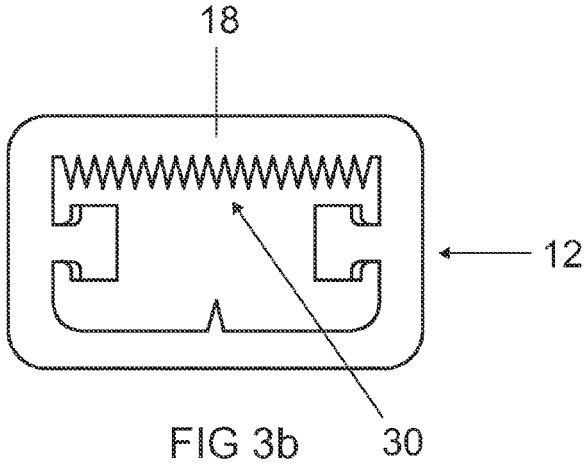

FIG. 3*a* shows an exemplary embodiment of a lamp 1 with a somewhat differently formed clip 12, in which the wide sides 18 have a plurality of tips 30 which are arranged consecutively like the teeth of a comb and protrude inwards. FIG. 3*b* shows a detail of a clip in which only one of the wide sides 18 has such teeth 30.

Figure 4:
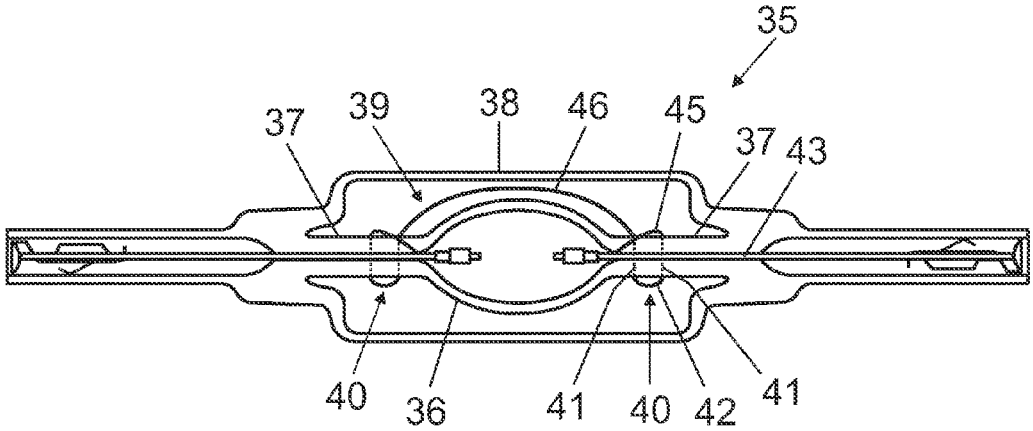
FIG. 4 a further exemplary embodiment of a high-pressure discharge lamp with ignition aid.

FIG. 4 shows a high-pressure discharge lamp 35, in which a discharge vessel 36 has two ends 37 which are in the form of cylindrical fusings. An outer bulb 38 is fastened to the ends of the fusings. Here the ignition aid 39 is a wire which is symmetrically distributed between both fusings. Each wire has an approximately U-shaped curved part 40, with two parallel legs 41 and a base 42 connecting the legs. A respective first leg 41, preferably the outside leg, is guided via a piece of extension wire 45 to the outside of the fusing as close as possible to the point at which the electrode enters the discharge vessel. The free end of the piece of extension wire 45 ends at the external surface of the fusing and is preferably in the shape of a tip. The respective second legs 41 are connected to each other via a connecting element which is in the shape of an arc 46.

Figure 5:
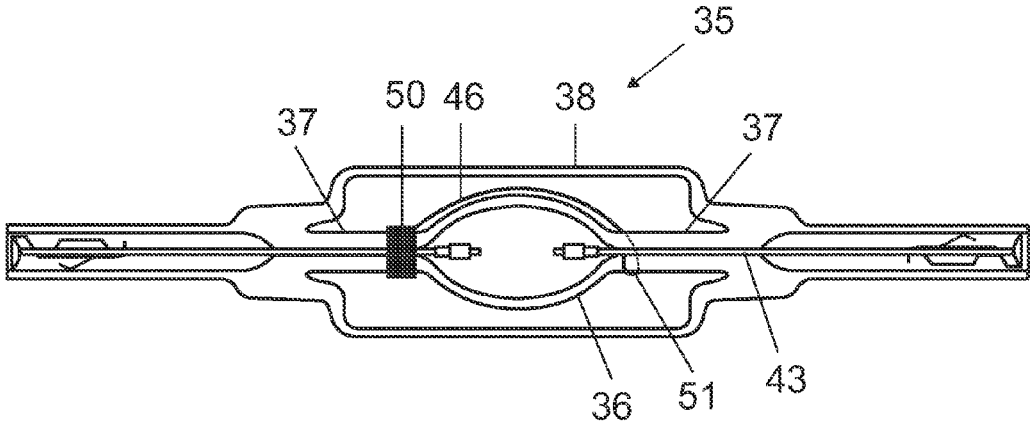
FIG. 5 a further exemplary embodiment of a high-pressure discharge lamp with ignition aid.

FIG. 5 shows a very similar exemplary embodiment of a lamp 35 in which a cuff 50 of sheet metal is fastened to the first fusing 37. From the cuff 50 a connection wire 46 goes to the second fusing 37, where analogously to FIG. 4 the wire is wound around the fusing (51) and ends at the external surface of the fusing, close to the point at which the electrode enters the discharge vessel.

Various ignition aid assemblies with burners made of quartz glass without krypton85 were examined at 400 W for their effectiveness during ignition. To this end the test samples were ignited for 20 seconds in conventional ballast mode using a standard ignition device and choke. The ignition pulse level was set at 3.5 kV and the supply voltage was reduced to 198 V. By means of time-resolved measurement of lamp current and voltage the time from application of the first ignition pulse until ignition of the burner was measured (start time). If ignition had not occurred after 20 seconds, measurement was terminated.

Figure 6:
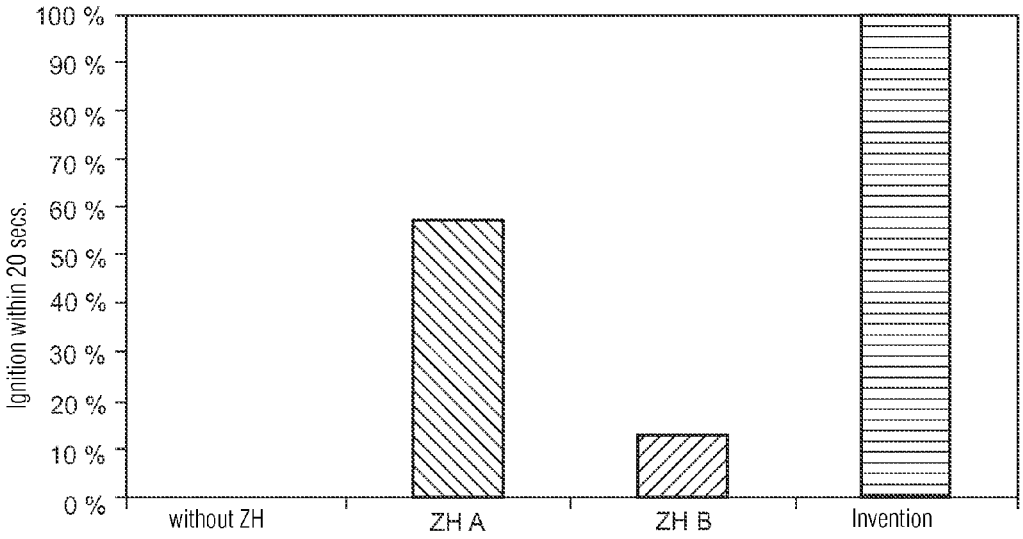
FIG. 6 a comparison of the ignitability of lamps with various ignition aids.

The following assemblies were compared:

1. Without ignition aid (ZH)—discharge vessel without ignition aid, filler gas in the outer bulb: air
2. ZH A—contacted ignition aid with wire winding, filler gas in the outer bulb: air
3. ZH B—contacted ignition aid with clip and wire, vacuum in the outer bulb
4. Invention—contacted ignition aid with clip and wire, filler gas in the outer bulb: air FIG. 6 shows the effectiveness of the ignition aid for each group.

Of the samples without ignition aid none started within 20 seconds. With ignition aid assembly A 58% of the samples, ignition aid assembly B 13% of the samples and with the ignition aid according to the invention 100% of the samples could be started under the ignition conditions employed. The comparison shows that through the excitation of a corona discharge in the outer bulb filler gas the ignition aid according to the invention can start lamps reliably even with relatively low ignition voltages. In particular an ignition aid (ZH B) identical in construction in which a corona discharge is prevented on account of the vacuum in the outer bulb is significantly less effective.

Figure 7:
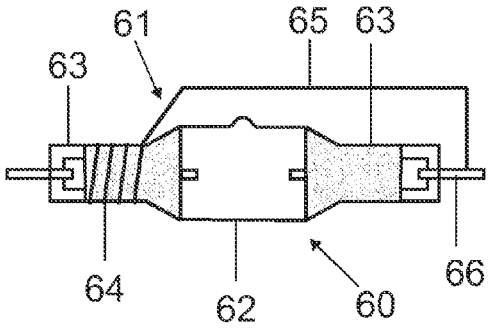
FIG. 7 a high-pressure discharge lamp with ignition aid, according to the prior art.

FIG. 7 shows the lamp 60 known from the prior art with ignition aid ZHA (61). The discharge vessel 62 has as ends two pinches or fusings 63, wherein a wire winding 64 with several windings wound around the end is attached to the first end 63, wherein the winding is connected to the second end 63 via a cross-connection wire 65. There the connection wire is connected to the current supply 66 which is protruding from the pinch 63.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A high-pressure discharge lamp having an ignition aid, having a discharge vessel that is surrounded by gas, wherein the discharge vessel comprises two ends having fusings in which electrodes are secured, wherein an ignition aid is fastened on at least one fusing, wherein the ignition aid has a local field amplifier in the form of a tip or a curved part, wherein the ignition aid is configured to cause a corona discharge in the surrounding gas which emits UV radiation into the discharge vessel, wherein the ignition aid is a clip which has a frame part with four sides and which is positioned on the fusing and surrounds this at least partially, wherein at least one tip extends inwardly from the frame part and in the mounted state points in the direction of the discharge volume.

2. The high-pressure discharge lamp as claimed in claim 1, wherein the gas is selected from the group of noble gases, air, nitrogen or mixtures thereof.

3. The high-pressure discharge lamp as claimed in claim 1,wherein at least one side of the frame part has a plurality of tips similar to the teeth of a comb.

4. The high-pressure discharge lamp as claimed in claim 1, wherein the discharge vessel is made of quartz glass and has a metal halide filling.

5. The high-pressure discharge lamp as claimed in claim 1, wherein the ignition aid is galvanically or capacitively coupled.

6. The high-pressure discharge lamp as claimed in claim 1, wherein the ignition aid has two parts which are distributed between the two fusings, wherein the two parts are connected via a conducting connection.

7. The high-pressure discharge lamp as claimed in claim 6, wherein the ignition aid as the first part has a cuff and as the second part a curved piece of wire, wherein the tip attached thereto ends at the second fusing outside at the height at which the electrode enters the discharge volume.

8. The high-pressure discharge lamp as claimed in claim 1, wherein the discharge vessel is housed in an outer bulb, which is filled with gas at a cold fill pressure of 10 mbar to 1 bar.

9. The high-pressure discharge lamp as claimed in claim 1, wherein the discharge vessel is open to air.

10. The high-pressure discharge lamp as claimed in claim 2, wherein the gas comprises Ar, Xe, or air.

11. A high-pressure discharge lamp having an ignition aid, having a discharge vessel that is surrounded by gas, wherein the discharge vessel comprises two ends having fusings in which electrodes are secured, wherein an ignition aid is fastened on at least one fusing, wherein the ignition aid has a local field amplifier in the form of a tip or a curved part, wherein the ignition aid is configured to cause a corona discharge in the surrounding gas which emits UV radiation into the discharge vessel, wherein the ignition aid is a wire with a free tip, wherein the free tip ends at the fusing outside at the height where the electrode enters the discharge volume.

12. The high-pressure discharge lamp as claimed in claim 11, wherein the wire comprises a curved part which is formed in a U-shape with two legs and a base, wherein the curved part is partially curved around the fusing, wherein a retaining effect is obtained at the fusing by the curved part.

13. A high-pressure discharge lamp having an ignition aid, having a discharge vessel that is surrounded by gas, wherein the discharge vessel comprises two ends having fusings in which electrodes are secured, wherein an ignition aid is fastened on at least one fusing, wherein the ignition aid has a local field amplifier in the form of a tip or a curved part, wherein the ignition aid is configured to cause a corona discharge in the surrounding gas which emits UV radiation into the discharge vessel, wherein the ignition aid is a spring sheet metal part to which at least one tip is attached.

14. The high-pressure discharge lamp as claimed in claim 13, wherein the tip is provided at the point where the clearance is smallest between the electrode and lamp exterior.

* * * * *